United States Patent [19]

Poe

[11] 4,209,194

[45] Jun. 24, 1980

[54] KEEPER FOR ROTARY LATCHES

[75] Inventor: L. Richard Poe, Long Beach, Calif.

[73] Assignee: Hartwell Corporation, Placentia, Calif.

[21] Appl. No.: 912,431

[22] Filed: Jun. 5, 1978

[51] Int. Cl.[2] ..... E05C 13/00

[52] U.S. Cl. ..... 292/341.18; 292/241

[58] Field of Search ..... 242/241, 341.18, 341.19, 242/155, 242

[56] References Cited

U.S. PATENT DOCUMENTS

| | | | |
|---|---|---|---|
| 1,560,489 | 11/1925 | Yager | 292/155 X |
| 3,223,441 | 12/1965 | Odend'Hal | 292/341.18 |

FOREIGN PATENT DOCUMENTS

| | | | |
|---|---|---|---|
| 461014 | 1/1951 | Italy | 292/341.18 |

*Primary Examiner*—Richard E. Moore

*Attorney, Agent, or Firm*—Lyon & Lyon

[57] ABSTRACT

An adjustable keeper for flush type rotary latches of the type having a semi-circular latch element; the keeper including a housing mounted on a frame confronting a hinged or otherwise movable panel carrying the latch; the housing including a socket disposed in a plane parallel to the panel which slidably receives a latch bar having a transverse bore including a cam surface facing toward the panel, the latch bar also having a loop end projecting from the housing and engagable with the latch element; the housing having a bore in registry with the transverse bore and in alignment with an access perforation provided in the panel; the housing bore being internally screwthreaded to receive a screwthreaded adjustment pin accessible through the access perforation to move the latch bar so as to effect engagement with the latch element; the latch bar being adjustable while engaging the latch element to vary the latching force applied to the rotary latch element.

2 Claims, 3 Drawing Figures

KEEPER FOR ROTARY LATCHES

BACKGROUND AND SUMMARY

This invention is directed to a keeper for rotary latches, particularly to keepers for flush type rotary latches used on aircraft such as, but not limited to, the type of rotary latch disclosed in FIGS. 10 through 14 of Application Ser. No. 856,504, which is summarized in the following objects:

First, to provide a keeper for panel mounted rotary latches which is externally accessible for adjustment of tension applied to the latch when the panel is closed and the keeper is in engagement with the latch.

Second, to provide a keeper, as indicated in the first object, which includes a novelly arranged keeper housing having a guide socket in essentially parallel relation to the panel, when closed, and a transverse screwthreaded bore confronting the panel, the socket receiving a keeper bar looped to receive the rotary latch and provided with a cam surface exposed to the bore, the bore receiving an adjustment screw accessible through a small perforation in the panel.

DETAILED DESCRIPTION

Figure 1:
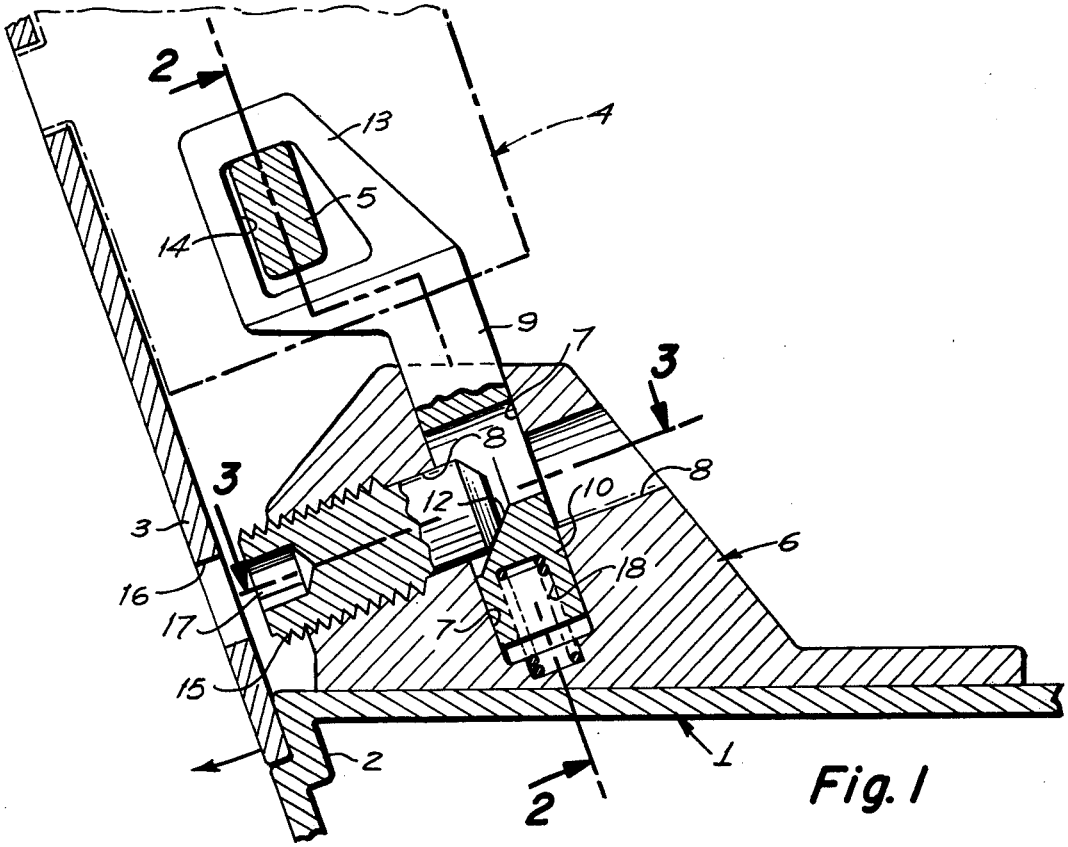
FIG. 1 is a sectional view of the keeper for rotary latches shown positioned in a frame supporting a removable panel.
Figure 2:
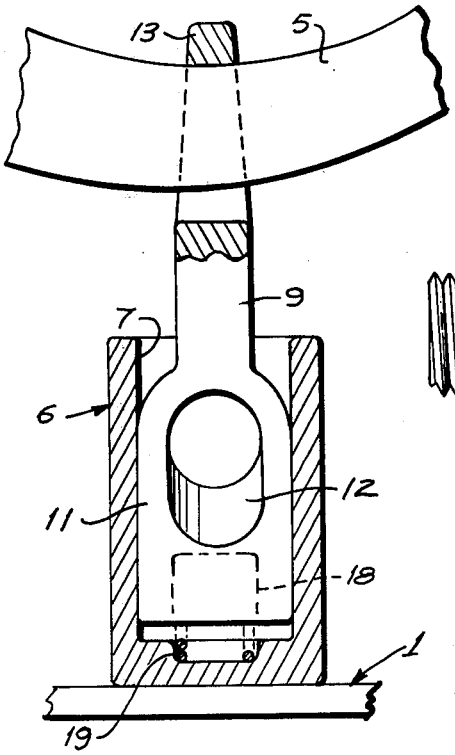
FIG. 2 is a sectional view with portions in elevation taken through 2—2 of FIG. 1.
Figure 3:
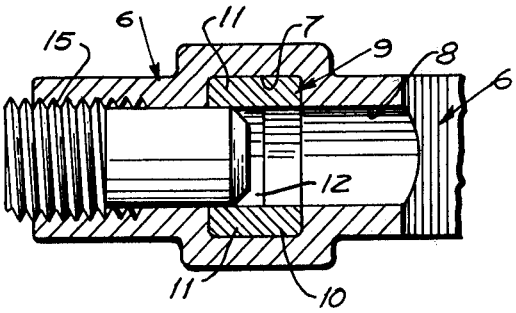
FIG. 3 is a sectional view taken through 3—3 of FIG. 1.

The keeper is mounted on a boundary frame 1 having a panel receiving margin 2 in wich is fitted a removable panel 3 which may be completely removable or may be hinged. The panel supports one or more latch structures 4 which for the purposes of this application may be considered as conventional. A latch structure suitable for use with the keeper is disclosed in the previously mentioned co-pending application. The latch structure is indicated fragmentarily by broken line except for a rotary latch element 5.

Secured at an appropriate location on the boundary frame 1 is a housing 6 which includes a keeper socket 7 disposed parallel to the panel 3. The keeper socket is intersected by a transverse bore 8 perpendicular to the panel.

A keeper bar 9 is provided which includes an inner portion 10 having a transverse perforation 11. A portion of the wall forming the perforation 11 is provided with a cam face 12 exposed to the transverse bore 8. The keeper bar 9 also includes an extended outer portion 13 having a latch receiving perforation 14.

The transverse bore has an entrance end in close confrontation to the panel 3; and the portion of the bore 8 between the inner portion 10 of the keeper bar and the panel is internally screwthreaded and receives an externally screwthreaded adjustment pin 15. The panel is provided with a perforation 16 which is in alignment with the adjustment pin 15 so that a polygonal bar may be inserted into a conforming socket 17 provided in the adjustment pin 15.

The adjustment pin 15 engages the cam face 12 to draw the keeper bar 9 into the keeper socket 7. In order to maintain the cam face 12 in contact with the adjustment pin 15, the inner end of the keeper bar 9 is provided with a socket 18 which receives a spring 19 urging the keeper bar outwardly with respect to the housing 6. The latch structure includes tool receiving element 20 accessible through a perforation 21 in the panel 3.

Operation of the keeper is as follows:

Initially the keeper bar 9 is in its extended position with respect to the housing 6. In this position the perforation 14 is readily received on the latch element 5. In this regard it should be noted that the rotary latch element is essentially circular and may be slightly off center so that its keeper bar is carried by a srewthreaded shank which can only be adjusted when the panel is open to expose the keeper bar. In the exercise of the present invention, the adjustment pin 15 is accessible through the perforation 16 so that the keeper bar 9 may be forced radially outward with respect to the center of rotation of the latch element 5.

Having fully described my invention, it is to be understood that I am not to be limited to the details herein set forth, but that my invention is of the full scope of the appended claims.

I claim:

1. An adjustable latch assembly adapted for installation substantially flush with a panel comprising:

a. a housing having a socket adapted to be positioned essentially parallel to said panel, and a bore intersecting said socket and adapted to be positioned essentially perpendicular to said panel;

b. a keeper bar having an inner end received in said housing socket, and including a cam surface exposed to the housing bore, and an outer looped end engagable with a latch element;

c. an adjustment screw received in the housing bore, and engagable with the cam surface while the keeper bar is in engagement with the latch element to change the force applied to the latch element; and d. yieldable means is positioned to maintain the cam surface in contact with the adjustment screw.

2. An adjustable keeper for latch elements, comprising:

a. a housing having a socket and a screwthreaded bore intersecting the socket;

b. a keeper having an inner end received in the socket and an outer end engagable with a latch element, the inner end including a cam element confronting the screwthreaded bore;

c., said screwthreaded bore containing an adjustable threaded means engagable with the cam surface to adjust the restraining force applied by the keeper to the latch element; and d. a spring is interposed between the inner ends of the socket and keeper for extending the keeper.

* * * * *